United States Patent [19]

Grimaldo

[11] Patent Number: 4,833,907

[45] Date of Patent: May 30, 1989

[54] CONSOLIDATED BACKSHOE DIE FOR A TUBE BENDER MACHINE

[76] Inventor: Samuel Grimaldo, 2539 Teller Rd., Newbury Park, Calif. 91320

[21] Appl. No.: 128,624

[22] Filed: Dec. 4, 1987

[51] Int. Cl.[4] ..... B21D 9/05

[52] U.S. Cl. ..... 72/389; 72/481; 72/478; 72/157

[58] Field of Search ..... 72/319, 219, 389, 481, 72/482, 157, 158, 478, 383, 396, 325

[56] References Cited

U.S. PATENT DOCUMENTS

| | | | |
|---|---|---|---|
| 1,662,428 | 3/1928 | Lowe | 72/158 |
| 3,429,157 | 2/1969 | Huth | 72/389 |
| 3,499,309 | 3/1970 | Gregg | 72/389 |
| 3,727,449 | 4/1973 | Johnston | 72/389 |
| 3,756,058 | 9/1973 | Hawkins et al. | 72/389 |
| 4,206,629 | 6/1980 | Grimaldo | 72/389 |

*Primary Examiner*—David Jones
*Attorney, Agent, or Firm*—Kelly, Bauersfeld & Lowry

[57] ABSTRACT

An improved consolidated backshoe die is provided for use in a tube bender machine used for bending metal tubing of the type used, for example, in vehicle exhaust systems and the like. The machine includes a bending die having a convexly curved die face for bending engagement with a metal tube supported by a pair of the consolidated backshoe dies mounted on an outwardly pivoting pair of back gates. The bending die is advanced along a line extending between the back gates to engage and bend the metal tube, with the back gates swinging outwardly in opposite directions as the tube is bent. The consolidated backshoe dies are each constructed from a plurality of interlocking backshoe members adapted for partial or complete assembly on the associated back gate, thereby providing a backshoe die of variable length to permit formation of tube bends at closely spaced positions along the metal tube. In a preferred form, the consolidated backshoe dies additionally include grooved die faces on opposite sides thereof to accommodate metal tubes of different diametric sizes, and the backshoe dies are adapted for reversible mounting on the back gates to present a selected one of the die faces toward the bending die.

14 Claims, 3 Drawing Sheets

FIG. 1
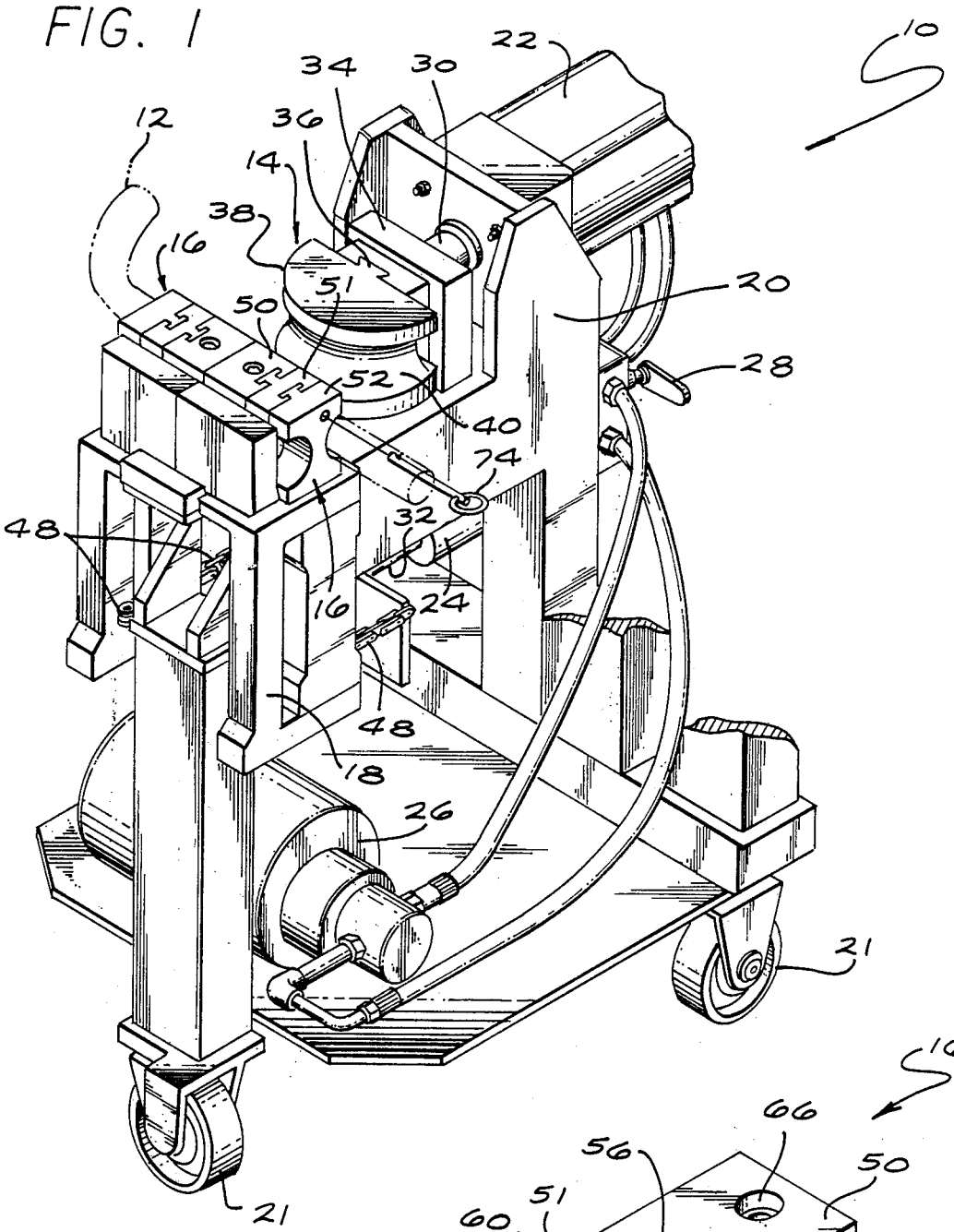
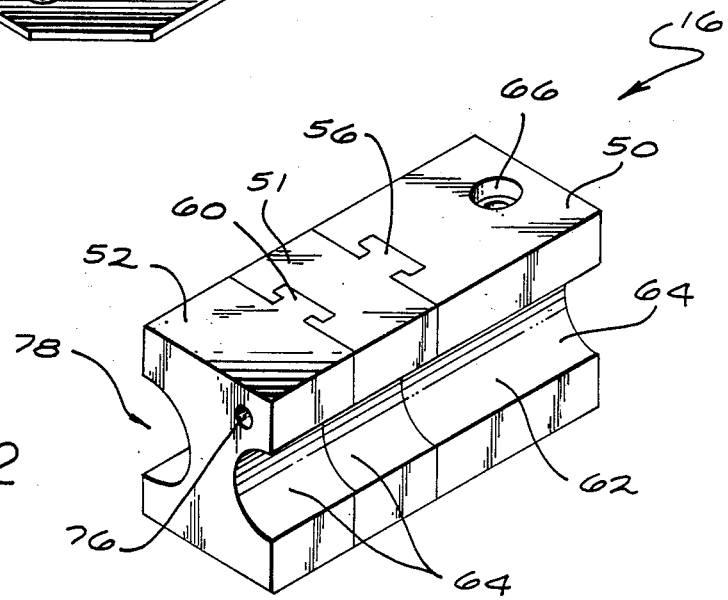
FIG. 2

FIG. 8
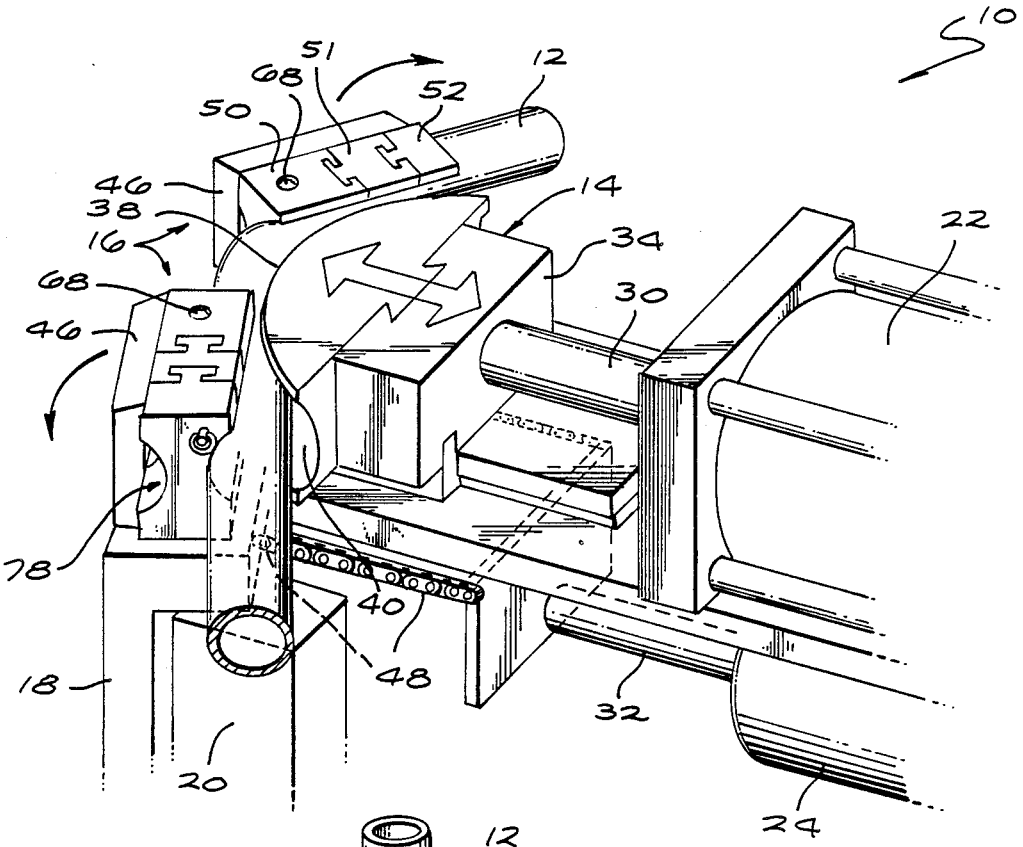
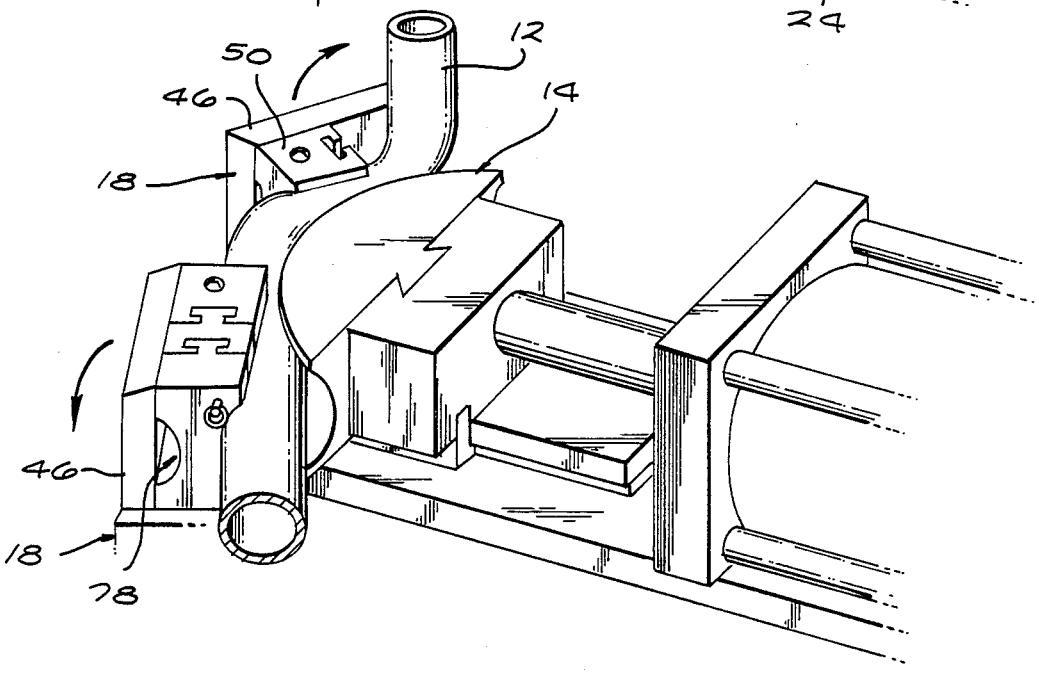
FIG. 9

CONSOLIDATED BACKSHOE DIE FOR A TUBE BENDER MACHINE

BACKGROUND OF THE INVENTION

This invention relates generally to improvements in backshoe dies of the type used in tube bender machines for bending metal tubing or the like to a selected configuration, wherein such bent tubing may be used, for example, in vehicular exhaust and tailpipe systems, etc. More particularly, this invention relates to improved backshoe dies designed to accommodate versatile machine operation in bending metal tubing, while requiring a significantly reduced number of costly tooling or die components for the machine.

Tube bender machines in general are relatively well known in the art for use in bending metal tubing to a selected configuration. Such tube bender machines are commonly used by automotive vehicle repair shops to shape a length of metal tubing in a customized fashion for use in a vehicle exhaust or tailpipe system. A typical tube bender machine includes a bending die carried by a hydraulic ram for advancement into bending engagement with a length of metal tubing supported by a pair of backshoe dies mounted respectively on an outwardly pivoting pair of back gates. The bending die has a convexly curved, typically semicircularly shaped bending die face which is advanced along a line extending between the pivot axes of the back gates. As the bending die pushes into the supported metal tube, the back gates with their backshoe dies react by pivoting outwardly in unison and in opposite directions away from the bending die. This combination of bending die and back gate pivoting motion cooperates to bend the metal tube through a selected angle, in accordance with the advancement stroke length of the bending die. Importantly, the bending die face and complementary die faces of the backshoe dies define a channel of generally circular cross section of a diametric size closely matching the size of metal tube being bent by the machine.

One commercial example of a tube bender machine of this general type is marketed under the trademark BLUE BOY, by American Machine & Hydraulics, Inc., of Thousand Oaks, Calif. See also U.S. Pat. No. 3,388,574.

While tube bender machines of the general type described above have experienced significant commercial use, a variety of disadvantages limit overall machine versatility and the speed at which a metal tube can be bent at several places to a selected configuration. More specifically, in metal tubes used for vehicle exhaust systems, multiple bends in the tube are frequently required at relatively closely spaced positions. Accordingly, it is common for one bend to be formed in the metal tube, followed by tube advancement a short distance along the backshoe dies and formation of a subsequent bend in the tube. However, the previously made bend is often sufficiently close to the succeeding bend such that the previous bend does not clear the backshoe dies and thus interferes with secure seating of the tube in the backshoe dies. In the past, this interference problem has been addressed by replacing the interfering backshoe die with a shorter backshoe die component, typically referred to as a three-quarter or one-half backshoe die depending upon component length. Unfortunately, this approach requires the machine owner to purchase a set of full and partial tooling components to fit both back gates, thereby significantly increasing overall machine cost and weight as well as the number of parts which must be organized and maintained by the machine operator. Significant operator time can be absorbed in locating and changing the backshoe die components between each formed bend.

In addition, it is well known that vehicle exhaust systems utilize metal tube of a wide range of different standard diametric sizes. Accordingly, to provide a full service tube bending capability, the machine owner is required to purchase and maintain a separate full set of backshoe die components for both back gates for each different diametric size of metal tubing, wherein each backshoe die set is usable to bend L metal tubing of a single diametric size. Once again, the total number of costly tooling components undesirably increases machine cost and enhances the likelihood of operational delays due to loss or misplacement of a single tooling die component.

There exists, therefore, a significant need for improvements in backshoe dies for use in a tube bender machine, wherein the total number of required tooling die components is significally reduced, and further wherein the tooling die components are designed for use with metal tube of more than one diametric size. The present invention fulfills these needs and provides further related advantages.

SUMMARY OF THE INVENTION

In accordance with the invention, an improved pair of consolidated backshoe dies are provided for supporting a metal tube in a tube bender machine during a tube bending procedure. The consolidated backshoe dies are formed from interlocking backshoe members designed to permit rapid reconfiguration of either backshoe die to an alternate length, as may be required, for example, when successive bends are formed in the metal tube at relatively closely spaced positions. In addition, the preferred consolidated backshoe dies embodying the invention are reversibly mounted onto the machine and include a pair of backshoe die faces shaped to accommodate metal tube of two different diametric sizes.

The tube bender machine comprises a machine frame carrying an hydraulic ram having a bending die mounted thereon. The bending die has a conventional convexly curved bending die face presented toward a pair of side-by-side back gates mounted on the machine frame for swinging movement in opposite directions. The consolidated backshoe dies are mounted respectively on the back gates and cooperatively support a metal tube in a position for bending engagement by the bending die. The bending die is advanced toward the metal tube along a line passing between the back gates and their associated backshoe dies. As the bending die engages the metal tube, the back gates and their backshoe dies are pivoted outwardly in opposite directions, with the combined die movements bending the metal tube through a selected angle. Support grooves of generally semicircular cross section are formed in the consolidated backshoe dies and in the bending die to define a generally circular channel within which the metal tube is supported during a bending procedure, with the diametric size of this channel conforming generally with the diametric size of the tubing to be bent.

The improved consolidated backshoe dies are each formed from interlocking backshoe members which, when assembled, define consolidated backshoe die faces presented in a direction toward the bending die. Each assembled backshoe die is adapted for rapid mounting onto the associated back gate, such as by means of a mounting bolt passing through a first or primary backshoe member and fastened into the associated back gate. The length of the die face presented by each backshoe die can be altered quickly and easily by removal or addition of the remaining backshoe members L relative to the first or primary backshoe member. A preferred interlocking arrangement comprises interengageable dovetail or T-shaped structures or the like adapted for sliding engagement or sliding separation by movement of a backshoe member in a vertical direction. The length of each backshoe die is thus easily varied as desired to permit formation of bends at closely spaced positions along a metal tube.

In accordance with further aspects of the invention, the improved consolidated backshoe dies include a pair of die faces defined by support grooves of generally semicircular cross section formed in opposite sides thereof. These semicircular support grooves have two different diametric sizes for use with metal tubing of two respectively different diametric sizes. Each backshoe die is mountable onto the associated back gate in a reversible manner, such as by inverting the backshoe die member upon the back gate, to present a selected one of the two die faces toward the bending die. Accordingly, each consolidated backshoe die is usable in bending metal tubing of two different diametric sizes.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a fragmented perspective view illustrating an improved tube bender machine having consolidated backshoe dies embodying the novel features of the invention;

FIG. 2 is a perspective view showing one of the consolidated backshoe dies;

FIG. 8 is a fragmented perspective view illustrating operation of the tube bender machine with a pair of the consolidated backshoe dies mounted thereon, with each of the backshoe dies defining a full size backshoe die lace; and FIG. 9 is a fragmented perspective view similar to FIG. 8 but depicting machine operation with one of the backshoe dies defining a partial backshoe die face.

DETAILED DESCRIPTION OF THE PREFERRED EMBODIMENT

Figure 3:
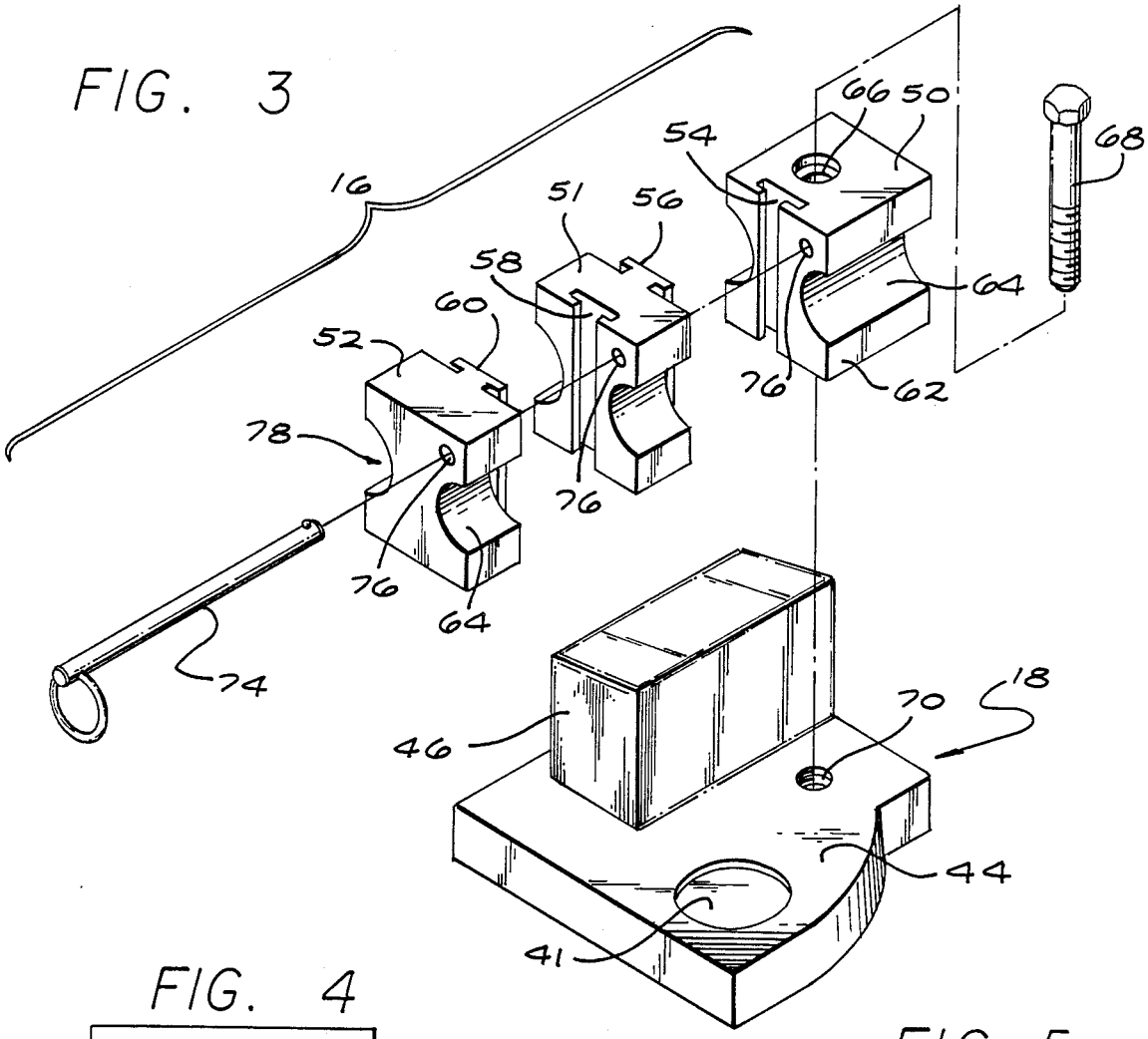
FIG. 3 is an exploded fragmented perspective view illustrating installation of the consolidated backshoe die of FIG. 2 onto the tube bender machine.

As shown in the exemplary drawings, an improved tube bender machine referred to generally by the reference numeral 10 is provided for bending a metal tube 12 shown in dotted lines in FIG. 1, particularly such as a metal tube of the type used for vehicle exhaust and tailpipe systems. The tube bender machine 10 includes a curved bending die 14 movable into bending engagement with the metal tube 12 which is supported by a pair of consolidated backshoe dies 16 mounted on a pair of outwardly swinging back gates 18. The consolidated backshoe dies 16 are each constructed from multiple interlocking backshoe members, as will be described in more detail, to permit rapid reconfiguration of the backshoe die length, and thereby permit formation of adjacent bends at closely spaced positions along the tube length (FIGS. 8 and 9).

The consolidated backshoe dies 16 of the present invention are designed for versatile use in the tube bender machine 10 for bending metal tubing of different diametric sizes into a custom geometry, while minimizing the total number of tooling die components required for machine operation. The improved backshoe dies 16 for the machine permit rapid selection and changing of backshoe die length without requiring an excessive number of tooling components to be purchased and maintained in an orderly fashion. Moreover, the backshoe dies 16 are designed for rapid reconfiguration by the machine operator to permit formation of successive bends with a minimum of intervening tooling reset time. Still further, in the preferred form, the improved backshoe dies are adapted for use with more than one diametric size of metal tubing, thereby further enhancing machine versatility with a minimum of tooling components.

The general construction and overall operation of the tube bender machine 10 is in most respects conventional in the art. More particularly, with reference to FIG. 1, the tube bender machine 10 comprises an upright rigid machine frame 20 which is desirably supported by small rollers or caster wheels 21 for easy portability, for example, about an automobile repair shop. The machine frame 20 supports a primary hydraulic cylinder 22 and an auxiliary hydraulic cylinder 24 mounted generally one on top of the other in coaxial relation. A standard pump 26 is also carried by the frame 20 for supplying hydraulic fluid under pressure through conduits 27 to the hydraulic cylinders 22 and 24, with appropriate controls 28 being provided to control fluid porting to and from the cylinders. Such fluid porting is effective to extend and retract an upper hydraulic ram 30 associated with the primary cylinder 22 and a lower hydraulic ram 32 associated with the auxiliary cylinder 24, all in a manner known to those skilled in the art.

Figure 6:
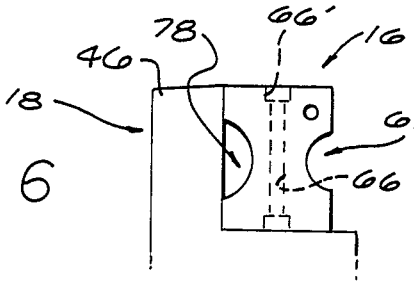
FIGS. 6 and 7 are somewhat schematic side elevation views of a portion of the tube bender machine to illustrate reversible or inverted mounting of the consolidated backshoe die onto the tube bender machine.
Figure 7:
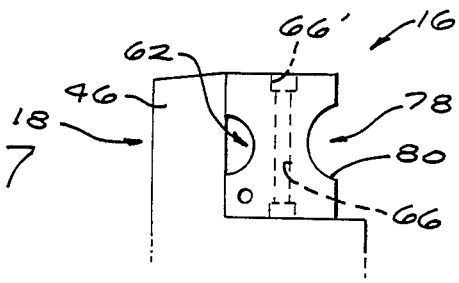

The upper or primary hydraulic ram 30 terminates in a pusher block 34 presented toward the backshoe dies 16. The bending die 14 is carried by this pusher block 34 for advancing movement toward the backshoe dies 16 into bending engagement with the metal tube 12, as will be described in more detail. This bending die 14 is adapted for rapid removable mounting onto the pusher block 34, for example, by means of a vertically oriented dovetail rail 36 on the bending die shaped for mating reception into a vertically oriented dovetail slot on the pusher block 34. A convexly curved die face 38 is defined by the bending die 14 and conventionally has a generally semicircular shape in the plan view presented toward the consolidated backshoe dies 16. This bending die face 38 is relieved to define a recessed groove 40 of generally semicircular cross sectional shape, as shown best in FIGS. 6 and 7, with the diametric size of the groove 40 corresponding closely with the diametric size of the tube 12 to be bent. When metal tubing of a different diametric size is to be bent, the bending die 14 is removed from the machine 10 and replaced with an alternate bending die (not shown) having a recessed groove in the die face thereof sized to match the diametric size of the metal tube to be bent. The alternate bending die may also have a convex plan shape formed with a different radius of curvature, if desired.

The bending die 14 is advanced during machine operation by the hydraulic ram 30 along a line constituting a centerline passing between the two back gates 18. In this regard, as viewed best in FIG. 1, the two back gates 18 are mounted side-by-side on the machine frame 20 for individual pivoting movement about a respective pair of vertically oriented bearings 41 (FIG. 8) positioned in laterally offset relation from the bending die path of motion. As viewed in FIGS. 1 and 8, the back gates 18 are pivotal between a closed or side-by-side position (FIG. 1) to an open position in laterally outward spaced relation (FIG. 8). In this regard, the back gates 18 operate in generally the same manner as the tube bender machine described in U.S. Pat. 3,388,574, which is incorporated by reference herein.

The two back gates 18 each include an upper generally horizontal platform 44, the rear side of which is closed by an upstanding back plate 46. The two consolidated backshoe dies 16 formed according to #the invention are respectively mounted on the back gate platforms 44 in bearing relation with the back plates 46. The backshoe dies 16 are geometrically shaped to provide stable support for the metal tub 12 to be bent during advancement of the bending die 14 into bending engagement with the metal tube, with the backshoe dies 16 being compressed by the bending action against the back plates 46.

More particularly, the bending die 14 is advanced by the upper hydraulic ram 30 to engage the metal tube 12 supported by the consolidated backshoe dies 16. Further bending die advancement causes the #backshoe dies 16 to pivot outwardly in opposite directions (FIG. 8), with the combined motion of the various dies bending the metal tube without significant disruption of the circular cross section. The angle of the bend formed in the tube 12 is functionally related to the depth of the stroke of the bending die 14, and may be suitably preset by angle control mechanisms (not shown) as described, for example, in U.S. Pat. No. 3,388,574. Moreover, the radius of curvature of the formed bend is controlled by the convex contour of the bending die face 38. For optimum machine control, the outward swinging movement of the back gates 18 is resisted by the auxiliary hydraulic ram 32 coupled by chains 48 or the like to the back gates. After completion of the desired angle bend, the rams 30 and 32 are retracted for subsequent advancement to form another bend in the metal tube.

In accordance with the invention, each of the consolidated backshoe dies 16 is formed from a plurality of interlocking backshoe members adapted for side-by-side mounting on the associated back gate, with three interlocked backshoe members 50, 51 and 52 being depicted in the illustrative drawings. More particularly, as shown best in FIGS. 1–3, the first or primary backshoe member 50 includes a dovetail or T-shaped vertical recess 54 in the outboard side thereof for mating slide-fit engagement with a dovetail or T-shaped key 56 on the inboard side of the second backshoe member 51. This second backshoe member 51 in turn includes a dovetail or T-shaped vertical recess 58 in the outboard side thereof for mating slide-fit reception of a dovetail or T-shaped key 60 on the inboard side of the third backshoe member 52. When assembled, these three backshoe members 50, 51 and 52 provide a full backshoe die of standard length, with the members 50–52 collectively defining a die face 62 with a recessed support groove 64 of generally semicircular cross section to support the tube 12 of a diametric size corresponding closely with the groove 64.

The first or primary backshoe member 50 of each backshoe die includes a vertically oriented mounting hole 66 for reception of a mounting bolt 68. As shown best in FIG. 3, this mounting bolt 68 is received downwardly through the mounting hole 66 and is fastened as by threaded engagement into a threaded bore 70 formed in the underlying back gate platform 44. The mounting bolt is preferably a hex head bolt, the head of which is adapted to fit into a countersink 66' formed in the backshoe member 50. The second and/or third backshoe members 51 and 52 can then be secured relative to the backshoe member 50 by appropriate interlocking of the respective T-shaped recesses and keys. When all three backshoe members 50–52 are assembled together on the back gate, the upstanding back plate 46 securely positions the backshoe members against displacement during a bending procedure, as will be described. A lock pin 74 may be provided for reception into horizontally aligned pin ports 76 in the backshoe members 50–52 to ensure maintenance of the desired transverse alignment therebetween.

Figure 4:
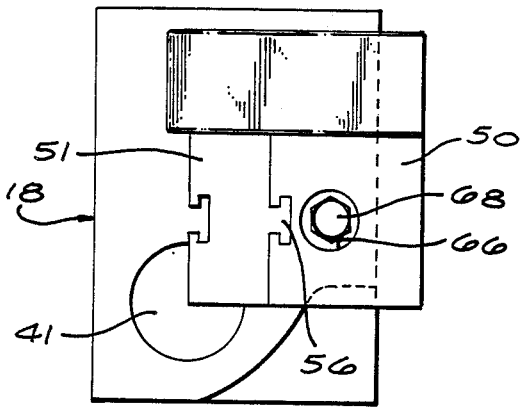
FIG. 4 is a top plan view of a portion of the tube bender machine and depicting partial removal of a portion of the backshoe die to provide a three-quarter size ,backshoe die face.
Figure 5:
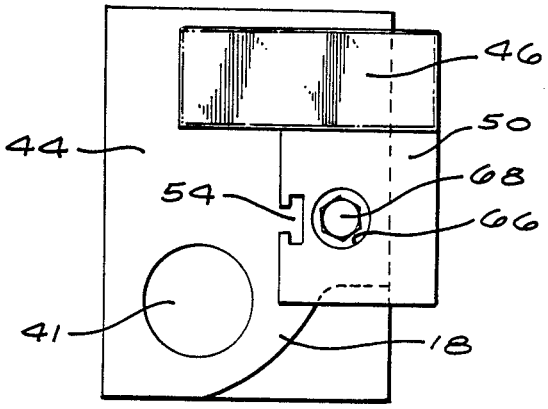
FIG. 5 is a top plan view similar to FIG. 4 but depicting removal of a second portion of the backshoe die to provide a one-half size backshoe die face.

Either one of the consolidated backshoe dies 16 can be partially disassembled quickly and easily to provide a shortened die face 62 when required, for example, typically such as when a bend is needed at a position spaced closely from a previous bend. For example, with reference to FIG. 8, both backshoe dies 16 are normally used with all three backshoe members 50–52 assembled together for maximum backstop support during a bending procedure. Specifically, when all three backshoe members 50–52 are used in assembled relation, the backshoe members 50–52 collectively define a full length die face 62 for maximum support of the tube 12 during bending. However, when closely spaced bends are needed as viewed in FIG. 9, either one of the dies 16 can be partially disassembled such as by removal of the second and/or third backshoe members 51 and 52 to provide a significantly shorter die face length. In the preferred form, the first backshoe member 50 is sized to provide a one-half size backshoe die face when both backshoe members 51 and 52 are removed (FIGS. 5 and 9). The first and second members combine to define a three-quarter size backshoe. die face when only the third backshoe member 52 is removed (FIG. 4).

In accordance with further features of the invention, the consolidated backshoe dies 16 include an additional or secondary die face 78 on the side thereof opposite the die face 62. This secondary die face 78 is defined by a recessed groove 80 of generally semicircular cross section formed with a diametric size different from the groove 64 of the die face 62. The diametric size of the secondary die face groove 80 is thus sized to accommodate and support a metal tube of different diametric size than the tube 12 which seats within the die face groove 64. The secondary die face 78 can be mounted to extend toward the advancing bending die by simple inversion of the backshoe die 16 (FIGS. 6 and 7) on the associated back gate. In this regard, the mounting hole 65 in the first or primary backshoe member 50 is countersunk at both ends thereof to receive the head of the mounting bolt 68. Alternately, the backshoe dies 16 can be reversed left to right upon the two back gates 18 to orient the die face 78 in facing relation with the bending die. Importantly, regardless of the orientation of the backshoe dies, either die 16 can be partially disassembled when required to permit formation of closely spaced bends in metal tubing.

The improved tube bender machine 10 of the invention thus provides a minimum number of tooling die components for use in forming a range of tubing bends, and for use in bending tubing of different sizes. There is no requirement to stock unique tooling die components for each and every different backshoe die configuration or tubing size. As a result, the machine operator can reconfigure the machine quickly and easily without significant risk of misplacement of a needed tooling component. Moreover, by elimination of many of the backshoe die tooling components required in the prior art, the overall machine is lighter in weight and less costly.

A variety of modifications and improvements to the invention described herein will be apparent to those skilled in the art. Accordingly, no limitation on the invention is intended by the description herein or the accompanying drawings, except as set forth in the appended claims.

What is claimed is:

1. In a tube bender machine for bending metal tubing or the like, said machine having machine frame, a bending die, ram means, carrying said bending die and operable to advance and retract said bending die along a predetermined path, a pair of back gates, and bearing means for pivotally mounting said back gates for swinging movement relative to said frame about respective axes offset to opposite sides of said predetermined path, said back gates being swingable between a substantially side-by-side closed position and an open position pivoted outwardly in opposite direction form each other, the improvement comprising:

a pair of backshoe dies for mounting respectively on said back gates in positions cooperating with said bending die upon advancement of said bending die along said predetermined path to support a metal tube, said back gates reacting to such bending die advancement to pivot outwardly from said closed position toward said open position to bend the metal tube;

said backshoe dies each being formed from a plurality of backshoe members mounted side-by-side onto the associated one of said back gates and including slide-fit means for interlocking said members in side-by-side relation to permit rapid slide fit assembly and disassembly of said members, said backshoe members being individually removable from said associated back gate to permit selected variation in the length of said backshoe die.

2. The improvement of claim 1 wherein said slide-fit means comprises a combination of vertically oriented, interlocking slots and keys formed in said backshoe members.

3. The improvement of claim 1 further including a lock pin for removable reception through aligned pin ports formed in said backshoe members.

4. The improvement of claim 1 wherein at least one of said backshoe members has a mounting hole formed therein, said associated back gate including an upwardly open threaded bore formed therein, and further including a mounting bolt receivable through said mounting hole for fastening into said bore to lock said one backshoe member on said associated back gate.

5. The improvement of claim 1 wherein said at least one backshoe die includes a pair of oppositely presented die faces formed therein for engaging and supporting metal tubing of respectively different sizes, said at least one backshoe die being reversibly mounted on said machine to present a selected one of said die faces in a direction generally toward said bending die.

6. The improvement of claim 1 wherein said at least one backshoe die includes first, second and third backshoe members, said first backshoe member defining a backshoe die face of about one-half length, said first and second backshoe members defining a backshoe die face of about three-quarter length, and said first, second and third backshoe members defining a backshoe die face of full length.

7. A tube bender machine for bending metal tubing or the like, said machine comprising:

a bending die;

a pair of back gates;

bearing means pivotally supporting said back gates for swinging movement relative to respective axes between a substantially side-by-side closed position and an open position pivoted outwardly in opposite directions from each other;

a pair of consolidated backshoe dies mounted respectively on said back gates; and means for advancing said bending die toward said back gates along a line extending between the pivot axes of said back gates, said bending die and said backshoe dies thereupon supporting a metal tube, with said back gates reacting to such bending die advancement to pivot outwardly in opposite directions from said closed position toward said open position to bend the metal tube;

each of said backshoe dies being formed from a plurality of sliding fit interlocking backshoe members mounted side-by-side on said respective back gates, said backshoe members being removable individually from said back gates to permit selected variation in the length of said backshoe dies.

8. The tube bender machine of claim 7 wherein each of said backshoe dies further includes a lock pin for removable reception through aligned pin ports formed in the backshoe members thereof.

9. The tube bender machine of claim 7 wherein said backshoe dies each include a pair of die faces for engaging and supporting metal tubing of respectively different sizes, said backshoe dies being mountable onto said back gates in alternative positions to present a selected one of said die faces in a direction generally toward said bending die.

10. The tube bender machine of claim 7 Wherein each of said backshoe dies includes first, second and third backshoe members, said first backshoe member defining a backshoe die face of about one-half length, said first and second backshoe members defining a backshoe die face of about three-quarter length, and said first, second and third backshoe members defining a backshoe die face of full length.

11. A consolidated backshoe die for use in supporting metal tube in a tube bender machine, said backshoe die comprising:

a plurality of backshoe members adapted for side-by-side mounting onto the tube bender machine, said backshoe members including interlocking means for mounting in side-by-side alignment, said backshoe members further cooperatively defining a die face for engaging and supporting a metal tube, said backshoe members being removable from the machine one at a time to permit selected variation in the length of said die face, said interlocking means including slide-fit means to permit rapid slide-fit assembly and disassembly of said backshoe members.

12. The backshoe die of claim 11 further including a lock pin for removable reception through aligned pin ports formed in said backshoe members.

13. The backshoe die of claim 11 wherein each of said backshoe members comprises a first, second and third backshoe members, said first backshoe member defining a backshoe die face of about one-half length, said first and second backshoe members defining a backshoe die face of about three-quarter length, and said first, second and third backshoe members defining a backshoe die face of full length.

14. The backshoe die of claim 11 wherein said backshoe members cooperatively define a pair of oppositely presented die faces formed thereon for engaging and supporting metal tubing of respectively different sizes.

* * * * *